US007118112B2

(12) United States Patent
Kenny et al.

(10) Patent No.: US 7,118,112 B2
(45) Date of Patent: Oct. 10, 2006

(54) TWO CARD POKER

(75) Inventors: James Thomas Kenny, Shorewood, IL (US); Larry Emmanuel Kekempanos, Oak Lawn, IL (US)

(73) Assignee: Kings Gaming, Inc., Oak Lawn, IL (US)

( * ) Notice: Subject to any disclaimer, the term of this patent is extended or adjusted under 35 U.S.C. 154(b) by 40 days.

(21) Appl. No.: 10/779,908

(22) Filed: Feb. 17, 2004

(65) Prior Publication Data

US 2004/0160006 A1 Aug. 19, 2004

Related U.S. Application Data

(60) Provisional application No. 60/448,669, filed on Feb. 19, 2003.

(51) Int. Cl.
*A63F 1/00* (2006.01)
*A63F 13/00* (2006.01)

(52) U.S. Cl. ..... 273/292; 463/13

(58) Field of Classification Search ..... 273/929, 273/250–299, 300–309, 100–149, 143 R; 463/1–49
See application file for complete search history.

(56) References Cited

U.S. PATENT DOCUMENTS

| | | | | |
|---|---|---|---|---|
| 5,645,281 | A * | 7/1997 | Hesse et al. | 273/292 |
| 5,678,821 | A * | 10/1997 | Hedman | 273/292 |
| 6,170,827 | B1 * | 1/2001 | Lombardo et al. | 273/292 |
| 6,345,823 | B1 * | 2/2002 | Webb | 273/292 |
| 2004/0009802 | A1 * | 1/2004 | Fargano | 463/13 |

* cited by examiner

*Primary Examiner*—Benjamin Layno
(74) *Attorney, Agent, or Firm*—Skokos Law Group, LLC; Soula Skokos, Esq.

(57) ABSTRACT

A method of playing a two card poker game by at least one player and a bank r who is preferably also the dealer. The game features multiple rounds of dealing out of the same deck(s). The player has the option to wager against the dealer, wager against a predetermined payout schedule, or both. Additional optional bets may be offered.

12 Claims, 9 Drawing Sheets

PAIR OR MORE
PAY TABLE A

| HAND TYPE | PAY |
|---|---|
| 2 JOKERS | 50 TO 1 |
| AK SUITED | 20 TO 1 |
| STRAIGHT FLUSH | 8 TO 1 |
| STRAIGHT | 2 TO 1 |
| ONE PAIR | 1 TO 1 |

FIG. 2

PAIR OR MORE
PAY TABLE B

| HAND TYPE | PAY |
|---|---|
| 2 JOKERS | 50 TO 1 |
| AK SUITED | 15 TO 1 |
| STRAIGHT FLUSH | 8 TO 1 |
| STRAIGHT | 2 TO 1 |
| ONE PAIR | 1 TO 1 |

FIG. 3

PAIR OR MORE
PAY TABLE C

| HAND TYPE | PAY |
|---|---|
| PAIR OF ACES | 16 TO 1 |
| STRAIGHT FLUSH | 6 TO 1 |
| ONE PAIR | 4 TO 1 |
| STRAIGHT | 2 TO 1 |

FIG. 4

ANTE KICKER
PAY TABLE D

| | |
|---|---|
| 2 JOKERS | 5 TO 1 |
| STRAIGHT FLUSH | 2 TO 1 |

FIG. 5

PAIR OR MORE
PAY TABLE E

| | |
|---|---|
| 2 JOKERS | 100 TO 1 |
| STRAIGHT FLUSH | 8 TO 1 |
| STRAIGHT | 2 TO 1 |
| ONE PAIR | 1 TO 1 |

FIG. 6

PAIR OR MORE
PAY TABLE F

| | |
|---|---|
| 2 JOKERS | 80 TO 1 |
| STRAIGHT FLUSH | 8 TO 1 |
| STRAIGHT | 2 TO 1 |
| ONE PAIR | 1 TO 1 |

FIG. 7

ANTE KICKER
PAY TABLE G

| | |
|---|---|
| 2 JOKERS | 5 TO 1 |
| STRAIGHT FLUSH | 2 TO 1 |

FIG. 8

ANTE KICKER
PAY TABLE H

| | |
|---|---|
| STRAIGHT FLUSH | 2 TO 1 |

FIG. 9

TWO CARD POKER

CROSS-REFERENCE TO RELATED APPLICATIONS

This application claims the benefit of U.S. Provisional Application No. 60/448,669 filed on Feb. 19, 2003.

BACKGROUND OF THE INVENTION

The present invention relates to gaming and to card games. More particularly, the present invention pertains to a method of playing a new type of poker game especially adapted for casino gaming, both in live table and electronic video formats.

Gaming establishments continually require new games to offer their players. Casinos seek games that are easy to play and deal and that also create many decisions per hour. In popular casino poker games such as "Three Card Poker", "Let It Ride" and "Caribbean Stud Poker" they have found such games that are faster that the traditional poker room type game (which also requires a larger table).

The problems associated with the above mentioned games are in the speed of the delivery to the customers. Players get bored waiting for the constant shuffling before they get to see a new hand. In each of the above listed popular casino poker games, each game only deals one hand to a player and then there is a shuffle. Therefore there is a constant need for the casino to get more "hands per hour" to increase the casino hold. The game of two card poker solves this problem by dealing more than one round of cards from the same deck (s) thus increasing the speed of the game. Time is saved by not having to shuffle as frequently. The players are happier because they get hands to them more quickly.

Insofar as the prior art is concerned, the art is particularly void of any disclosures or showings of a two card poker game or of any game that deals more than one round from a single deck (s). The patent to Webb U.S. Pat. No. 6,345,823 discloses a card game which may either be played in either a three card variation, or a five card variation. While the patent mentions a two card version of the game it includes a wild card to make a three card hand. Hence, the wagering system is dependant upon a three card hand and is not dependant upon the best hand with two cards. Webb fails to disclose a two card capability to make a two card straight or flush or the dealing of more than one round of cards from the same single deck, and or more than one round from at least two decks.

Insofar as the prior art is concerned, the art is void of any disclosures or showings of a two card poker game that appreciates a 2 card straight or a 2 card flush by dealing only two cards. Additionally, the art is of any disclosures or showings of any poker game, which deals more than one round of poker from at least a single deck(s) and before a shuffle. The game features multiple rounds of poker being dealt from the same deck(s) and before a shuffle. This feature, which is non-obvious and novel, shall be incorporated into poker hands that can be featured in either two card poker games, three card poker games, four card poker games, five card poker games, six card poker games and or any other predetermined amount of cards for a poker game(s).

The patent to Goldman, U.S. Pat. No. 5,997,002 discloses a poker style casino game which uses a 52 card standard deck plus an additional 5 jokers for a total of 57 cards. The game concludes with the comparison f a five card poker hand between the dealer and the player (s). Goldman reveals that the jokers used are not wild and thus are bad for a player to get because they can not now complete their five card hands. Goldman fails to reveal any capability to make a two card poker hand or deal more than one round from a single deck (s).

OBJECTS AND ADVANTAGES OF THE INVENTION

It is an object of the present invention to provide an enjoyable new card game.

It is a further object of the present invention to provide a game which is easy to play and deal.

It is a further object of the present invention to provide a game that has the ability to deal more than one round of poker from a deck (s) of cards.

It is a further object of the present invention to increase the hands per hour of traditional poker style games.

It is a further object of the present invention to provide a game which has the ability to use more than one standard deck of playing cards (with or without jokers).

It is a further object of the present invention to provide a game which allows a player the option to make a side wager on the hand value of the dealers' hand.

Further objects and advantages of the present invention will become apparent from the consideration of the ensuing description and drawings.

SUMMARY OF THE INVENTION

The present invention discloses a poker game variation in which one or more players play against the casino. Broadly, the invention is directed to a poker game variant in which a player has a choice between several wagers among the following; a wager against a dealer, a wager against a pre-determined pay scale, a second wager against a dealer, a second wager against a pre-determined pay scale, a bad beat wager, a wager on the dealers hand, a wager combining the players own hands, a wager on receiving a joker (s), or a progressive wager.

In one preferred embodiment of the present invention, one or more players initially place a wager(s) and then two cards are dealt to the player and two cards are dealt to the dealer. Players would inspect their hands and decide whether to fold or to continue to play. If the player was playing a wager against the dealer and wanted to continue to play, they would place another wager in support of their first wager in the appropriate betting area. The dealer would inspect his/her hand to see if they qualified. If the dealer did not qualify with a pre-determined rank of cards, the dealer would pay th first wager of the player and return the supporting wager. If the dealer had a qualifying hand, then the player and the dealer would compare their best two-card hand to determine the winner. Tie hands would be a push. If the player had also made a wager against the dealer and had supported that wager, and the player's outranks the dealer, they would be eligible for a payoff for achieving a winning hand. If the player had also made any wagers against achieving a pre-determined rank, and achieves such a rank, the player would win that wager accordingly. This version, would include a standard deck of 52 playing cards and 2 jokers.

In a second embodiment of the present invention the game would be dealt as previously described except there would be no jokers used. The highest hand would be a straight flush.

In a third embodiment of the present invention at least two decks would be used. The game would still have multiple rounds of play. Joker(s) would be used in certain versions and not others. The jokers may be wild or used just to form a pair.

In a fourth embodiment of the present invention a player may wager on a combination of the cards he receives, for the different rounds, to form certain poker hands.

In a fifth embodiment of the present invention a player may draw a card to replace one of the cards first given.

It is contemplated that in the game of the present invention, for the game to begin, the casino may either require the dealer or the player to achieve a qualifying hand. If the dealer must qualify and he does not, then the initial wager made by the player against the dealer would be paid. If the player was required to qualify and did not, then the player would forfeit their initial wager against the dealer. The game may be played without requiring any of the participants to have a qualifying hand in order to continue with the game.

A novel gaming layout for use in the casino version of the game is also disclosed.

There has thus been outlined, rather broadly, the more important features of the invention in order that the detailed description thereof that follows may be better understood, and in order that the present contribution to the art may be better appreciated. There are, of course, additional features of the invention that will be described hereafter and which will form the subject matter of the claims appended hereto. In this respect, before explaining at least one embodiment of the present invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods, and systems for carrying out the several purposes of the present invention. It is imp rtant, therefore, that the claims be regarded as including such equivalent c nstruction insofar as they do not depart fr m the spirit and scope of the present invention.

BRIEF DESCRIPTION OF THE DRAWINGS

FIG. 2 is a chart indicating winning poker hands and their payouts in one example of a wager against a predetermined pay scale of the present invention;

FIG. 3 is a chart indicating winning poker hands and their payouts in one example of a wager against a predetermined pay scale of the present invention;

FIG. 4 is a chart indicating winning poker hands and their payouts in one example of a wager against a predetermined pay scale of the present invention;

FIG. 5 is a chart indicating winning poker hands and their payouts in one example of a wager against a predetermined pay scale of the present invention;

FIG. 6 is a chart indicating winning poker hands and their payouts in one example of a wager against a predetermined pay scale of the present invention;

FIG. 7 is a chart indicating winning poker hands and their payouts in one example of a wager against a predetermined pay scale of the present invention;

FIG. 8 is a chart indicating winning poker hands and their payouts in one example of a wager against a predetermined pay scale of the present invention;

FIG. 9 is a chart indicating winning poker hands and their payouts in one example of a wager against a predetermined pay scale of the present invention;

DETAILED DESCRIPTION OF THE PREFERRED EMBODIMENT

Figure 1:
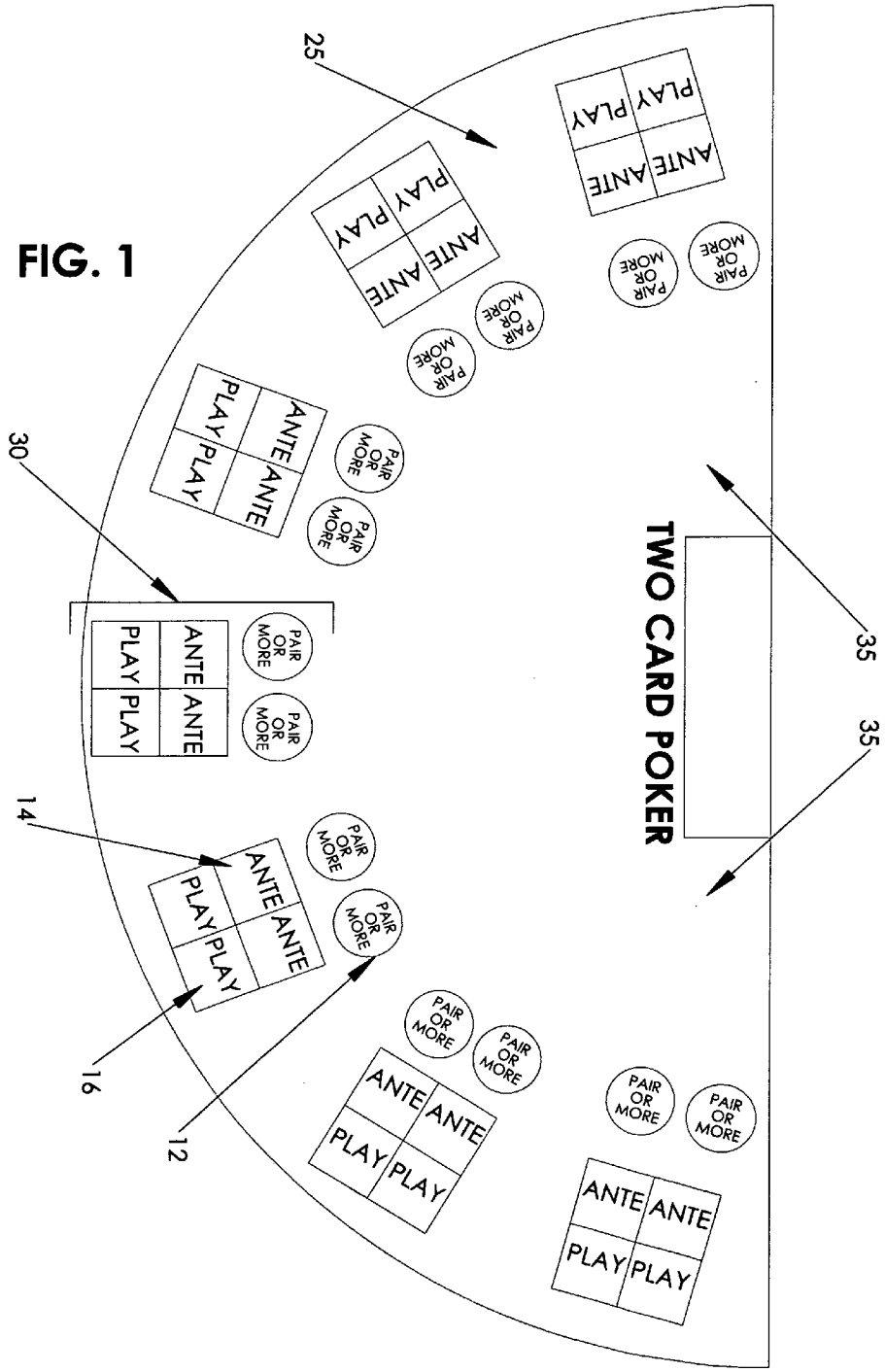
FIG. 1 shows a playing surface for use in playing a card game of one embodiment of the present invention.

According to a preferred embodiment of the present invention, players play against a casino. However, in jurisdictions where such games are not legal, such as in California, one player may be designated "Player-Dealer" and all the other players would play against the Player-Dealer. The option to act as Player-Dealer would be offered to each player in their turn. In this specification, the term "Dealer" is intended to refer to either a casino dealer, or a Player-Dealer, whichever is appropriate for the circumstances under which the game of the present invention is played.

FIG. 1 shows a playing surface or table layout 25 on which one embodiment of the present invention is played. The layout 25 may be marked or placed on any suitable surface such as a gaming table. For example, the layout may be in the form of a layout cloth supported on a supporting surface. The layout provides a playing area 30 for a plurality of players, for example seven players, and a separate area 35 for a banker who also preferably acts as the dealer. Each playing area 30 has a number of marked sections or zones 12, 14, 16 for the placing of various wagers by a player as will be described hereafter.

Each player takes a place at one of the playing areas 30. The game is played in a number of rounds as will be described. In each round, each player has the option of playing against the dealer, or wagering on the rank of his/her or a combination of the two. The player will further have the option of making additional bets for a second round of cards, before the first round is dealt and before the cards are shuffled. In other variations of the game, the player may be offered more options. The preferred embodiment of the present invention is played with a standard deck of 52 playing cards plus two jokers. The two jokers together form the highest hand or combined with another card, form a pair.

At the beginning of the game each player decides whether to play that particular round by wagering against the dealer, i.e. an "ANTE"wager, by wagering on the hand value only, i.e. "Pair or More" wager, or both. The player must now also make his/her wages for the second round. To play against the dealer a player makes an ANTE wager by placing an appropriate wager, such as a token or chip, or where permitted, cash, on the section 14 of his/her/playing area 30. The gaming chip may be of any conventional kind and available in a number of denominations such as are well known within the art. The casino will post the house betting limits. If a player wishes to wager based on the value of his/her hand, the player would place an appropriate token, chip, or cash on the "Pair of More" wager in section 12 of his/her playing area 30. In the present example, the rules of the game provide that payouts will be made according to a displayed payout schedule with "Pair or More" payouts starting at a pair or better. In one embodiment of the present invention, hands are ranked according to the following hierarchy, though other rankings may be used:

Highest:

Joker version rankings;

| | |
|---|---|
| 2 Jokers | |
| Mini Royal | Ace/King of one suit |
| Straight Flush: | Two of one suit in sequence |
| | K, Q highest ranking straight flush |
| | 2, A lowest ranking straight flush |
| Straight: | Two in sequence |
| | A, K highest ranking |
| | K, Q second highest ranking and so on until |
| | A, 2 lowest ranking straight |
| 1 Pair: | Two of one rank |
| | A, A highest |
| | K, K next highest ranking pair, and so on until |
| | 2, 2 lowest ranking pair |
| Flush: | Two of one suit |
| | A, Q highest ranking flush |
| | K, J next highest ranking, and so on, until |
| | 4, 2 lowest ranking flush |
| High Card: | (A hand comprising none of the above) |
| | A, Q highest |
| | A, J next highest ranking card, and so on, until |
| | 4, 2 lowest ranking high card |

Ace is high, but can be low in Straight A,2 and Straight Flush A,2

This is but one of many different ways to rank the cards.

The payout schedule may be varied in accordance with the rules of the game and/or the casino. For example, another version of the game may eliminate the jokers and have the following rankings:

Non-joker version:

Straight Flush

One Pair

Straight

Flush

High Card

One of the wagering options in one embodiment of the present invention is a wager against a payscale. The bet is called "Pair or More" and has the following payscale as one example:

| | |
|---|---|
| 2 Jokers | 50 to 1 |
| Mini-Royal | 20 to 1 |
| Straight Flush | 8 to 1 |
| Straight | 2 to 1 |
| Pair | 1 to 1 |

Another of the options in a second embodiment of the present invention would be to have a game that did not use any jokers and an example of a possible payscale for the "Pair or More" bet would be:

| | |
|---|---|
| Pair of Aces | 16 to 1 |
| Straight Flush | 6 to 1 |
| One Pair | 4 to 1 |
| Straight | 2 to 1 |

The payout schedules are preferably displayed in a convenient manner and location. At times the payscales for different wagers and any extra ante bonus payouts will be displayed on the playing layout itself and at other times the payouts will be on mobile display material.

According to a preferred embodiment of the present invention the initial two wagering options of an Ante bet against a dealer or a "Pair or More" wager against a payscale may be of unequal amounts.

When the above wagers are in place, the dealer preferably shuffles the cards (manually or by shuffler) and then deals a two-card hand to each player and themselves.

The cards may either be dealt face up or face down depending upon casino policy.

When the cards have been dealt, any player who has placed an ANTE wager inspects his/her hand and determines whether to fold and forfeit their bet or to stay in by placing a support wager in the PLAY area. The Play wager is preferably the same as the ANTE wager. The PLAY wager is made by placing an appropriate chip on the section 16 marked "PLAY" on the player's playing area 30. When the player has made the wager then he/she places the cards in the Play area below the Play wager section 30.

If a player forfeits his/her ANTE wager, the dealer takes the wager and the players cards are discarded before the game proceeds.

"Pair or More" wagers are not affected to this point. However, a player playing the "Pair or More" wager only, places his/her cards in the playing area if they wish to continue the hand. If the player wishes to forfeit or fold their hand they would indicate this by tossing their hand forward towards the dealer. If the player is also playing against the dealer with an ANTE wager, he/she must make a PLAY wager if he/she has a winning "Pair or More" wager.

The dealer reveals his/her cards and shows their best two card poker hand. The dealer then in turn reveals each other players cards (if they have not already been revealed), compares the players best two card poker hand to that of the dealer's, and resolves each players wager(s).

All the players with an ANTE and a PLAY wagers are automatically winners if the dealer does not qualify with a Queen/Six high hand or better. This rank may be varied in accordance with the rules of the game or the casino. Players are preferably paid even money on the ANTE wager and their PLAY wager is a push.

If the dealer does qualify with a Queen/Six high hand or better, each player's hand is compared with that of the dealer. If the player's hand is higher ranked, then the player is paid even money on the ANTE and PLAY wagers. If the player's hand is of a lower rank then that of the dealer's, the player loses both the ANTE and PLAY wagers. If the dealer and the player have exactly the same hand, then the hand is a push and the player may either withdraw his/her/wager, leave it, or adjust it for the next round.

The present game may also provide for an additional payout to be made by the dealer, to the player who has made an ANTE wager and a PLAY wager, if the player achieves a predetermined hand ranking. The extra payout would be called the ANTE KICKER and would be paid regardless of the player beating the dealers hand or not. One preferred payout schedule would be:

ANTE KICKER

| | |
|---|---|
| 2 Jokers | 5 to 1 |
| Straight Flush | 2 to 1 |

Players who have wagered on the value of the hand (I.E. Pair or More) win if the hand is at least a Pair and are paid by the dealer according to the posted pay scale. These payouts are independent of the results of the game against the dealer.

This procedure completes one-half of the hands of the game.

Players who had wagered on a second set of cards would now be dealt two new cards, from the remaining cards in the deck, and two new cards would be dealt to the dealer. Play would continue once again as shown above.

This procedure completes a single round of play of the game. Play then continues in another round, with players commencing to make wagers on the Ante and/or the Pair or More bets.

This novel method of playing a game may be utilized with playing cards or as an electrical or electro-mechanical device such as a slot machine. Those skilled in the art will appreciate that suitable controls can be provided for receiving the necessary input and therefore is within the scope of the present invention to provide a multi-unit video format wherein a plurality of players may play against each other and/or against a dealer.

From the present description, those skilled in the art will appreciate that various modifications may be made without departure from the scope of the present invention. For example, the naming of the different wagers, the naming and/or ranking of any hand, the changing of the necessity of qualifying hands for both the dealer and/or the player, the payout schedule, and predetermined winning or losing ranks may be varied in accordance with the rules of the game or the requirements of the casino.

The table game layout may be varied from that which is described and shown. The rules may be varied, or additional rules imposed, within the scope of the invention. Additional optional or mandatory wagers may be incorporated into the game with a view toward enhancing the players interest and ability to win additional wagers.

One such bet is a "Bad Beat Wager". If allowed the player may place a "Bad Beat Wager" before the cards are dealt out. The player would be wagering that they would achieve a hand of at least a certain published rank and that this hand would be beaten by the dealer's hand of a higher rank. The player would lose this optional bet if the hand did not achieve the posted minimum ranking and did not get beaten by the dealer's hand.

It will be appreciated that additional marked zones may be provided to accommodate any additional optional side bets. The marking of the betting zones would be noted accordingly so that the player would know where to place their wager.

The precise wagering requirements may vary depending upon the casino rules but the nature of the game will stay the same, that is, a two card poker game dealt with multiple rounds from at least one deck. The precise wagering system can be varied in that any number of additional and/or optional bets may be incorporated into the game, or additional mandatory bets may be incorporated by different house rules. These changes are not deemed to be a critical part of the present invention rather the criticality is in the playing of a two card poker game with multiple rounds of hands.

It is to be understood that the present invention is not limited to the sole embodiment described above, but encompasses any and all embodiments within the scope of the following claims.

The invention claimed is:

1. A method of playing a poker wagering game with a dealer and at least one player comprising the steps of:

(a) providing at least one standard deck of 52 playing cards plus at least one joker;

(b) providing a published poker ranking of winning hands ranked from highest to lowest;

(c) providing a pre-determined pay scale for winning hands;

(d) providing a pre-determined minimum hand ranking for a dealer to achieve as a qualifying hand;

(e) starting a round of play wherein each player making certain initial wager(s) of the following types of wagers;

(i.) a first wager against the dealer, and (ii.) a voluntary wager against a predetermined pay scale, (f) dealing only two cards to each player to form a player's two card poker hand;

(g) dealing only two cards to the dealer to form a dealer's two card poker hand, wherein the two cards dealt to the player and the two cards dealt to the dealer are the only two cards dealt during the first round of play;

(h) giving the player the option of ending wagering game and forfeiting all initial wagers made in step (e) above if said player does not wish to continue to play the wagering game;

(i) giving the player option of proceeding to play the wagering game against the dealer by player placing a third support wager in support of the first wager against the dealer;

(j) the game ending if the dealer fails to achieve said qualifying hand in accordance with said pre-determined minimum hand ranking and dealer paying the player's certain initial wager(s), if wagered, against said predetermined pay scale;

(k) the game proceeding if the dealer has achieved said qualifying hand in accordance with said pre-determined minimum hand ranking and the player has not ended game in step (h) above;

(l) comparing the player's two card poker hand against the dealer's two card poker hand;

(m) identifying the outcome of the wagering game by correlating the player's and dealer's two card poker hands to the published ranking of winning hands, and paying the winning hand as follows:

(i.) if the player's hand outranks the dealer's hand according to the published ranking of winning hands, dealer pays the player's certain initial wager(s) against the dealer and player's third support wager;

(ii.) if the player has achieved a rank at least as high as the first ranking according to the published ranking, dealer pays the player's separate voluntary wager against said predetermined pay scale;

(iii.) if the dealer's hand outranks the players hand according to the published ranking of winning hands, dealer takes the player's certain initial wager(s) against the dealer and player's third support wager;

(iv.) if the player fails to achieve at least the minimum ranking according to the published ranking of winning hands, dealer takes the player's separate voluntary wager against said predetermined pay scale; and (v.) if the player has the same ranking as the dealer according to the published ranking of winning hands, the dealer returns the player's certain initial wager(s) and player's third support wager;

(n) giving the player option of starting a new round of play by repeating steps (e) through (m) before a shuffle of the standard deck of 52 playing cards plus at least one joker is made and ending the first round of play and new rounds of play by collecting the playing cards and returning the played cards to the at least one standard deck of 52 cards plus at least one joker.

2. The method of playing a wagering game as set forth in claim 1, wherein the game is played with a standard deck of 52 cards with no jokers.

3. The method of playing a wagering game as set forth in claim 1, wherein there is only one round of cards delivered before the shuffle.

4. The method of playing a wagering game as set forth in claim 1, wherein there is more than one deck of cards used for the wagering game.

5. The method of playing a wagering game as set forth in claim 1, wherein the number of rounds dealt to the players before the shuffle is greater than two.

6. The method of playing a wagering game as set forth in claim 1, wherein a player is provided an opportunity to make a bad beat wager including the further steps of:

Providing a pre-determined published ranking of winning bad beat hands;

Permitting the player to place an additional wager against said pre-determined published ranking of winning bad beat hands;

Providing that the player may win said additional wager even in the event the player's hand is outranked by the dealer's hand so long as the player's hand appears on the said pre-determined published ranking of winning bad beat hands.

7. The method of playing a wagering game as set forth in claim 1, wherein the player may bet on the value of the dealer's hand.

8. The method of playing a wagering game as set forth in claim 1, wherein the game may have a designated wild card, produced electronically.

9. The method of playing a wagering game as set forth in claim 1, wherein a different version of the game may have the player needing to qualify to continue play.

10. The method of playing a wagering game as set forth in claim 1, wherein no participant had to qualify to continue play.

11. The method of playing a wagering game as set forth in claim 1, wherein the number of jokers used is two.

12. The method of playing a wagering game as set forth in claim 1, wherein a third support wager may be a multiple of the first wager against the dealer.

* * * * *